United States Patent [19]

Sibalis

[11] Patent Number: 4,677,412

[45] Date of Patent: Jun. 30, 1987

[54] ENERGY SUPPLEMENTED ELECTRICAL FUSE

[76] Inventor: Dan Sibalis, 268 Hallock Rd., Stony Brook, N.Y. 11790

[21] Appl. No.: 627,494

[22] Filed: Jul. 6, 1984

Related U.S. Application Data

[63] Continuation of Ser. No. 402,648, Jul. 28, 1982, abandoned.

[51] Int. Cl.[4] ..... H01H 37/76

[52] U.S. Cl. ..... 337/401; 337/416

[58] Field of Search ..... 337/401, 406, 402, 404, 337/413, 416

[56] References Cited

U.S. PATENT DOCUMENTS 3,132,320 5/1964 Gee et al. ..... 337/401 X
3,705,373 12/1972 Cameron ..... 337/401 X
3,885,223 5/1975 Green ..... 337/406
3,958,206 5/1976 Klint ..... 337/401 X
4,124,835 11/1978 Cahill ..... 337/404 X

FOREIGN PATENT DOCUMENTS 930526 7/1963 United Kingdom ..... 337/401

*Primary Examiner*—George Harris
*Attorney, Agent, or Firm*—Lieberman, Rudolph & Nowak

[57] ABSTRACT

An electrical fuse adaptable for a wide range of current rating and response times. The fuse comprises a conductive element and an explosive charge, the latter shearing the conductive element at a predetermined temperature. In the disclosed embodiments, the explosive charge can be heated to the detonation temperature using a variety of auxiliary heat sources.

4 Claims, 6 Drawing Figures

ENERGY SUPPLEMENTED ELECTRICAL FUSE

This application is a continuation, of application Ser. No. 402,648, filed July 28, 1982 abandoned.

TECHNICAL FIELD

This invention relates to electrical fuses, and more particularly, to an electrical fuse which operates by detonating an explosive charge.

BACKGROUND OF THE INVENTION

Fuses are widely used in the home and in industrial environments to prevent unacceptably large electrical currents from damaging electrical conductors and equipment. Known fuses typically provide the protective function by destroying a conductive path therein so as to produce an open-circuit condition which effectively disconnects the protected equipment from an electrical source. The designer of electrical fuses, therefore, must consider the operating parameters and conditions of the equipment which is intended to be protected. One such design parameter is the current rating or maximum current which a fuse must conduct without producing a circuit interruption. Another design parameter is the response time, or fusing speed, which may be defined as the time which elapses between the application of an overload current and the interruption of the flow of current by the fuse.

In its most basic form, a fuse contains a somewhat resistive conductive element which is electrically disposed between two electrical terminals which permit interconnection of the fuse in a circuit to be protected. During an overload condition, the heat which is generated by the flow of current through the resistive conductive element causes a material in the element to melt and to vaporize. In a more advanced type of known fuse, commonly referred to as a dual element fuse, two or more conductive elements, along with a mechanism, are serially connected to one another. This known combination precludes premature current interruptions for overloads which are either slight or short lived, such as the starting currents of electrical motors; and yet provides satisfactory open-circuit response to excessive overloads.

The above-described prior art fuse configurations provide satisfactory current protection for heavy electrical equipment. However, such known fuses are generally not suited for protecting circuitry which has a low maximum current rating, and which requires a short response time. Thus, it is a problem with known fuses that they are not generally suitable for protecting semiconductor devices. Indeed, conventional fuses often generate sufficient heat to limit the number of fusinq devices which can be installed in a small enclosure.

It is, therefore, an object of this invention to provide an improved current interruption device which requires less energy to interrupt a current flow in a circuit then conventional fuses.

It is a further object of the invention to provide a current interruption device which contains stored energy, the stored energy being released to interrupt a flow of electrical current upon the occurrence of predetermined thermal conditions.

It is yet another object of the invention to achieve an interruption of an electrical current in a shorter period of time from the application of an overload condition than would be required by a conventional fuse arrangement.

SUMMARY OF THE INVENTION

The foregoing and other objects are achieved by the present invention which provides a fuse having a conductive element and at least one adjacently mounted explosive charge. At a predetermined temperature corresponding to abnormal current or temperature conditions, the explosive charge is detonated so as to rupture the conductive element. A feature of the present invention is that this fuse structure can be tailored to a wide range of current or temperature ratings along with a variety of response times.

In one embodiment of the invention, there is provided a further explosive charge which serves to detonate the adjacently mounted explosive charge. Such a plurality of explosive charges permits optimization of the fuse with respect to the explosive materials employed in the respective explosive charges. For example, a first explosive charge may detonate at an advantageously low temperature, but may not have sufficient explosive energy to rupture the conductive element with the required reliability. The first explosive charge may therefore be utilized as a primer to detonate a second, higher energy charge, which contains an explosive material which would self-detonate at a higher ambient temperature. Thus, an advantageous combination is achieved wherein the desirable low temperature detonation characteristic of the first explosive charge initiates a higher energy explosion in the second explosive charge which ruptures the conductor.

BRIEF DESCRIPTION OF THE DRAWINGS

Comprehension of the invention is facilated by reading the following detailed description in conjunction with the annexed drawings, in which.

DETAILED DESCRIPTION

Figure 1:
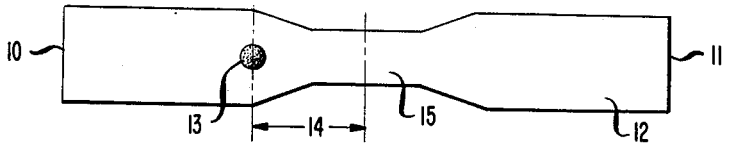
FIG. 1 is a plan view of a fuse constructed in accordance with the principles of the invention.
Figure 2:
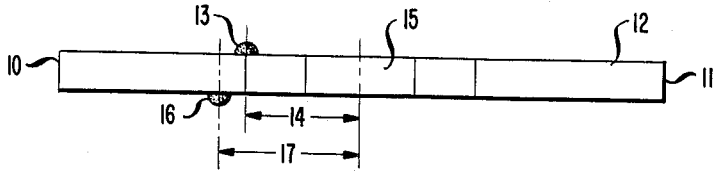
FIG. 2 is a side view of the embodiment at FIG. 1.

An exemplary fuse pursuant to a first embodiment of the present invention is shown in FIGS. 1 and 2. The fuse comprises a conductive element 12 which extends from a first end 10 to a second end 11. Ends 10 and 11 can each be connected to electrical conductors (not shown) so that conductive element 12 is serially disposed between an electrical source and electrical circuitry to be protected. Explosive charges 13 and 16 are each affixed at a preselected position on opposite surfaces of element 12. Element 12 is shown as having a uniform cross-sectional thickness in FIG. 2. However, the cross-sectional thickness may be advantageously configured to be non-uniform, (see for example, FIG. 6). In one embodiment, the cross-sectional thickness of the conductive element is reduced near an explosive charge so that the energy required to shear element 12 is substantially reduced. For a given explosive composition, the conductive element material, element length, and cross-section defines, using well-known structural principles, the amount of explosive material required. Each explosive charge comprises a low exotherm, thermally-activated explosive material. While a variety of explosive materials can be used, a shaped charge comprising a calcium dinitrobenzofuroxan primer and lead azide explosive is preferable. A shaped charge directs the forces generated upon detonation toward the conductive element. The aforementioned primer ignites at a temperature of approximately 220°–225° C. and the lead azide is attractive due to its cost. Other suitable explosive materials are pentaerythritol or lead tstyphnete.

At the primer igniting temperature, the shaped charge detonates and element 12 is sheared. The required temperature can be generated by the flow of current through element 12 and/or the heat created by surrounding equipment. The shearing of element 12 by either cause is complete, thereby limiting the arc across the broken elements. It should be noted that while the illustrated fuse has an extremely short response time, a delay in severing element 12 can be introduced by increasing the center-to-center distance 14 and 17 between each charge and narrow width element section 15. The use of second charge 16 is often times unnecessary, and, for purposes of clarity,will be omitted in the other embodiments of the invention described hereafter.

In applications where the fuse is disposed in a room temperature environment, the maximum current rating can be reduced to an extremely low level by preheating the charge to a threshold temperature slightly below the primer igniting temperature. Consequently, only a very small current induced temperature rise is required.

Figure 3:
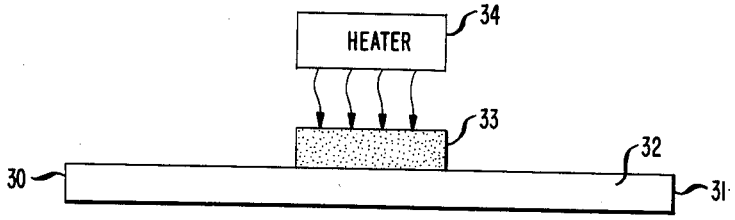
FIG. 3 is a side view of a second embodiment of the invention.
Figure 4:
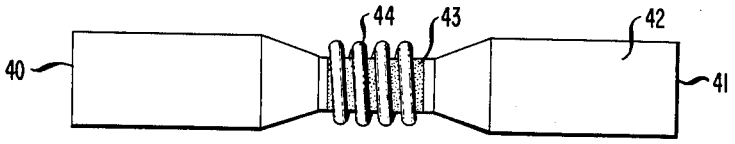
FIG. 4 is a plan view of a third embodiment of the invention.
Figure 5:
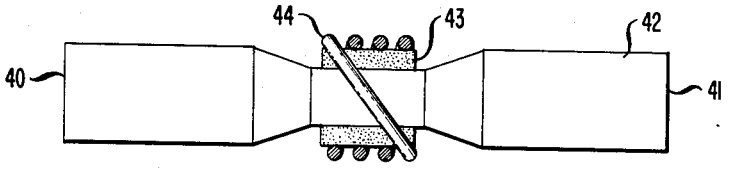
FIG. 5 is a partial cross-sectional view of the embodiment of FIG. 4.

Referring to FIG. 3, the desired threshold temperature can be generated by a conventional resistive heater 34, heating an explosive charge 33 which is affixed to a conductive element 32. The conductive element extends from an end 30 to a further end 31. In another embodiment, shown in FIGS. 4 and 5, an explosive charge 43 is disposed on a conductive element 42 having ends 40 and 41. A short-circuited secondary winding 44 of a transformer is wrapped about charge 43. The conductor 42 is the primary winding. Accordingly, a varying current in conductor 42 induces a short-circuit current in the secondary winding which heats charge 43 to the desired threshold temperature. The magnitude of the short-circuit current can be increased, if necessary, by wrapping the transformer windings about a magnetically permeable core.

Figure 6:
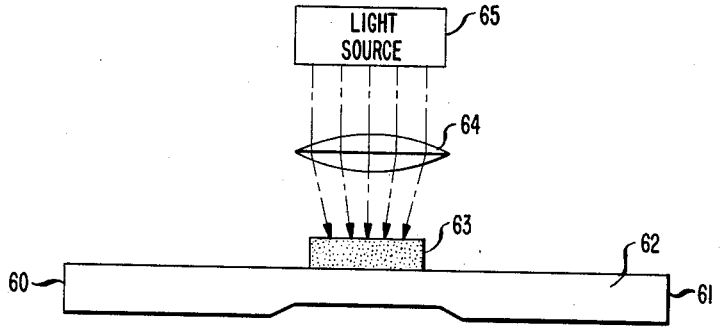
FIG. 6 is a side view at a fourth embodiment of the invention.

Finally, in the embodiment of FIG. 6, charge 63 is disposed on element 62 which extends from an end 60 to an end 61. A heating of charge 63 to a predetermined threshold temperature is accomplished by focussing light therein from a source 65 of electromagnetic radiation, e.g., a laser, using a lens 64. As such, this embodiment is suitable for monitoring the output power of optical devices, or for use as a remote triggered one-shot N.C. switch.

In addition, due to the construction described above, the device of the instant invention can be used to provide over temperature protection in addition to over current protection. Also since the fuse link does not have to generate energy for melting and vaporizing the metal, the energy lost in the fuse link is negligable and the fuse can be made extremely fast as described above. Both military and commercial applications are with the scope of the invention. While the operation of the present invention has been discussed with reference to a single element fuse, the present invention is equally applicable to multiple element fuses. Accordingly, the drawings and description in this disclosure are proffered to facilitate comprehension of the invention, and should not be construed to limit the scope thereof.

What is claimed is:

1. An apparatus for interrupting an electrical current upon the occurrence of predetermined overload conditions, the apparatus comprising:

conductor means having a conductive path intermediate of first and second ends of said conductor means for conducting a current which is to be interrupted upon the occurrence of the predetermined overload conditions;

energy storage means responsive to said current which is to be interrupted for releasing a sufficient quantity of energy upon the occurrence of the predetermined overload conditions to cause said conductive path to be open-circuted, said energy storage means further comprising a first explosive material for explosively releasing said quantity of energy upon being heated to a predetermined threshold temperature, and said conductive path being dimensionally configured of a conductive material so as to have a predetermined hear-generating characteristic with respect to current whereby said predetermined threshold temperature is exceeded when the electrical current is flowing therethrough at a rate which corresponds to the predetermined overload conditions; and auxiliary heating means for delivering thermal energy to said energy storage means such that said first explosive material is heated to a preselected preheat temperature which is below said predetermined threshold temperature by a predetermined amount.

2. The apparatus of claim 1 wherein said auxiliary heating means comprises a resistive heating element.

3. The apparatus of claim 1 wherein said auxiliary heating means comprises a transformer having a secondary winding which is connected for short-circuit operation.

4. The apparatus of claim 1 wherein said auxiliary heating means comprises a source of electromagnetic radiation.

* * * * *